US009223292B2

(12) United States Patent
Junod

(10) Patent No.: US 9,223,292 B2
(45) Date of Patent: Dec. 29, 2015

(54) WRISTWATCH FITTED WITH AN ANIMATION ABOVE THE DIAL

(71) Applicant: MONTRES JAQUET DROZ SA, La Chaux-de-Fonds (CH)

(72) Inventor: François Junod, Sainte-Croix (CH)

(73) Assignee: MONTRES JAQUET DROZ SA, La Chaux-de-fonds (CH)

( * ) Notice: Subject to any disclaimer, the term of this patent is extended or adjusted under 35 U.S.C. 154(b) by 0 days.

(21) Appl. No.: 14/417,682

(22) PCT Filed: Jul. 9, 2013

(86) PCT No.: PCT/EP2013/064500

§ 371 (c)(1),
(2) Date: Jan. 27, 2015

(87) PCT Pub. No.: WO2014/019819

PCT Pub. Date: Feb. 6, 2014

(65) Prior Publication Data

US 2015/0205264 A1 Jul. 23, 2015

(30) Foreign Application Priority Data

Jul. 31, 2012 (CH) ..... 1231/12

(51) Int. Cl.
*G04B 25/06* (2006.01)
*G04B 45/00* (2006.01)

(52) U.S. Cl.
CPC ..... *G04B 25/06* (2013.01); *G04B 45/0038* (2013.01)

(58) Field of Classification Search
CPC ..... G04B 45/00; G04B 45/0038; G04B 25/06
USPC ..... 368/15–20, 243, 282, 285
See application file for complete search history.

(56) References Cited

U.S. PATENT DOCUMENTS

| | | | | |
|---|---|---|---|---|
| 2,504,811 | A | 4/1950 | Davis et al. | |
| 4,583,864 | A * | 4/1986 | Graves | 368/17 |
| 5,272,681 | A * | 12/1993 | Lee | 368/62 |
| 5,305,292 | A * | 4/1994 | Reynoso | 368/281 |
| 5,652,736 | A | 7/1997 | Lee | |
| 6,388,953 | B1 * | 5/2002 | Wu | 368/76 |

(Continued)

FOREIGN PATENT DOCUMENTS

| | | |
|---|---|---|
| CH | 32172 A | 6/1905 |
| CH | 55403 A | 8/1912 |

(Continued)

OTHER PUBLICATIONS

International Preliminary Report on Patentability, dated Feb. 3, 2015, issued by the International Searching Authority in counterpart Application No. PCT/EP2013/064500.

(Continued)

*Primary Examiner* — Sean Kayes
(74) *Attorney, Agent, or Firm* — Sughrue Mion, PLLC

(57) ABSTRACT

A wristwatch including a watch case; a clock movement in said watch case and a dial. At least one part of a three-dimensional figure above the dial can be caused to move in a plane non-parallel to the dial by a shaft extending above the dial in a direction perpendicular to the dial. A device for driving the figure is arranged below the dial to control the movements of this shaft. The figure can be formed by a mechanical bird.

18 Claims, 2 Drawing Sheets

(56) References Cited

U.S. PATENT DOCUMENTS

| | | | | |
|---|---|---|---|---|
| 7,905,655 | B2 * | 3/2011 | Jolidon | 368/101 |
| 2011/0069590 | A1 * | 3/2011 | Jolidon | 368/15 |

FOREIGN PATENT DOCUMENTS

| | | | |
|---|---|---|---|
| CH | 668846 | A5 | 1/1989 |
| DE | 20310007 | U1 | 10/2003 |
| EP | 0 490 666 | A2 | 6/1992 |
| EP | 0 564 407 | A1 | 10/1993 |
| JP | 61-96391 | U | 6/1986 |
| JP | 63-19289 | U | 2/1988 |
| JP | 1-97282 | U | 6/1989 |
| JP | 7-191155 | A | 7/1995 |

OTHER PUBLICATIONS

International Search Report for PCT/EP2013/064500 dated Jan. 2, 2014 [PCT/ISA/210].

* cited by examiner

WRISTWATCH FITTED WITH AN ANIMATION ABOVE THE DIAL

CROSS REFERENCE TO RELATED APPLICATIONS

This application is a National Stage of International Application No. PCT/EP2013/064500, filed on Jul. 9, 2013, which claims priority from Swiss Patent Application No. 1231/12, filed on Jul 31, 2012, the contents of all of which are incorporated herein by reference in their entirety.

1. Technical Field

The present invention relates to a wristwatch fitted with an animation above the dial.

2. Prior Art

Songbirds are known in particular in cuckoo clocks or in snuff boxes. The cuckoo clock concept was created around 1738 in the Black Forest. Traditionally, these clocks have a visible balance animated by weights and a decorated case in the form of a chalet. The doors of the chalet open every hour or every half hour and a mechanical bird springs up from its nest and sings. Nowadays, cuckoo clocks mostly comprise a quartz movement and electronic striking mechanisms.

Swiss patent CH 55403, granted in 1911, describes an innovation to existing cuckoo clocks consisting of a mechanism that actuates figures arranged on the front of the clock upon each call of the cuckoo.

U.S. Pat. No. 2,504,811 describes a table clock with a cuckoo that enables a tune composed of different notes to play and one or more parts of the bird such as the beak or the tail to move simultaneously. A bellows allows air to be injected into the whistle.

CH 668846 describes a snuff box comprising a mechanical songbird positioned in a case fitted with a lid. The bird can move from a movable lying position of rest to a vertical singing position under the action of a spring mechanism controlled by a spring catch. The activation of the mechanism automatically produces a cycle of operations comprising the opening of the lid and simultaneously the emergence of the bird in singing position, then the singing of the bird and finally the stopping of the singing, the return of the bird into the lying position of rest, the closure of the lid and the stopping of the mechanism itself.

Cuckoo clocks and other devices mentioned above have a very significant space requirement and are therefore difficult to carry.

Different attempts have also been made to animate the dial of wristwatches with different displays superposed on the time display.

Thus, Swiss patent CH 32172 describes a pocket watch having two-dimensional blacksmiths above the dial that are caused to oscillate by the watch movement.

The German Utility Model DE 20310007 U1 describes a wristwatch or a pocket watch comprising a bird positioned behind a window that opens at a given hour simultaneously with the emission of a cuckoo sound, the window then closing again.

Such two-dimensional moving parts in front of or behind the dial create a poorly visible animation. The size of the animated elements above or below the dial must necessarily be limited to allow space for the other time indications. Users who are not directly above the dial are likely to not see the animation at all, which is solely intended for the wearer of the watch.

Furthermore, these two-dimensional moving parts move in a plane parallel to the dial above or below this dial. Such a movement is poorly visible for a person not in a position vertical of the dial. Moreover, this movement covers a significant surface area above or below the dial, which cannot be used for other displays of the watch.

Therefore, there is a need for wristwatches that have more visible animations above the dial, e.g. in order to mark particular events such as the passage of an hour, an alarm time or simply the wish of the user in a much more visible manner, which cannot escape the attention of the wearer of the watch and even that of other persons in the immediate vicinity of the wearer of the watch.

BRIEF SUMMARY OF THE INVENTION

Therefore, it is an object of the present invention to propose a wristwatch that has an animation above the dial that is more clearly visible than the known animations.

According to the invention, this object is achieved in particular by means of a wristwatch having the claimed features.

According to one aspect the wristwatch comprises:

a watch case;

a clock movement in said watch case;

a dial;

a three-dimensional figure above said dial;

a shaft extending above said dial in a perpendicular direction to the dial and arranged so as to be able to produce a movement of at least one part of said three-dimensional figure in a plane non-parallel to the dial;

a device for driving the figure below said dial to control the movements of said shaft.

This watch has the advantage that it has a three-dimensional figure above the dial that is more clearly visible than a two-dimensional object.

In this application the term figure covers both humans and animals.

A three-dimensional animated figure in a wristwatch produces a surprise effect, since such figures known in much larger devices are completely unexpected in a wristwatch.

This watch additionally has the advantage of animating this figure or at least a part of this figure by moving it in a plane non-parallel to the dial.

This movement is more clearly visible than a movement parallel to the dial and, moreover, occupies a less significant amount of surface area of the dial that can be made available for other indicators.

The movement of the figure and/or a part of the figure can include at least one translational motion component non-parallel to the dial.

The movement of the figure and/or a part of the figure can include at least one rotational motion component around an axis non-perpendicular to the dial.

The three-dimensional figure can include a part that is movable in relation to the rest of the figure. A shaft perpendicular to the dial can control the movements of this movable part.

In addition to these movements in a plane non-parallel to the dial the figure or a part of this figure can also perform an additional movement, e.g. a rotation and/or a translational movement, in a plane parallel to the dial. This renders the animation even more clearly visible, even if this movement parallel to the dial is of little amplitude.

Different parts of the figure can move in different non-parallel planes. Parts of the figure can perform non-planar movements.

The wristwatch can comprise several coaxial shafts extending above the dial in a direction perpendicular to the latter and arranged in order to move, independently of one another, one or more parts of the figure and/or the whole figure. For example, one shaft can control the movement of the whole figure. Another shaft can control the movement of a part of the figure. A third shaft can possibly be provided to control the movement of a third part of the figure.

The figure can be in the form of a mechanical bird. The beak and/or wings and/or tail of this mechanical bird can be movable in relation to the body of the bird. The body of the bird can be movable in relation to the dial. The beak and/or wings and/or tail of this mechanical bird can be movable in a plane non-parallel to the dial. The body of the bird can be movable in a plane parallel to the dial.

In an embodiment the body of the mechanical bird performs a rotation on itself around an axis perpendicular to the dial, while the head, the tail and the wings perform rotations around axes non-perpendicular to the dial.

The body of the figure, e.g. the bird, can be hollow and house a mechanism for moving parts of the figure, e.g. for moving the beak and/or wings and/or tail of said bird in dependence on the movements of the shaft or shafts.

The clock movement and the device for driving the figure can be independent of one another.

The device for driving the figure can comprise a first barrel and the clock movement can comprise a second barrel. The two barrels can be wound independently of one another.

The device for driving the figure can comprise a first control member. The clock movement can comprise a second control member. The two control members can be independent of one another. The precision of the second control member can be markedly higher than the precision of the first control member. The first control member can be formed by a simple brake or an inertia block device for braking the movements of the figure. The second control member can be formed by a spring balance assembly.

In a variant the clock movement can drive the device for driving the figure. The clock movement can supply the necessary energy for this drive action. The clock movement can determine the moment at which this figure starts to be driven. The clock movement can regulate the speed of movement of the figure.

The device for driving the figure can comprise a whistle configured to imitate the sound of a bird.

The wristwatch can comprise a glass above the dial and the figure, wherein a first part of this glass covers the dial and a second part of this glass covers the figure. The second part can be more curved than the first part. The two parts can be welded or glued to one another.

BRIEF DESCRIPTION OF THE DRAWINGS

Exemplary embodiments of the invention are shown in the description illustrated by the attached figures, wherein.

EXAMPLE(S) OF EMBODIMENT OF THE INVENTION

Figure 1:
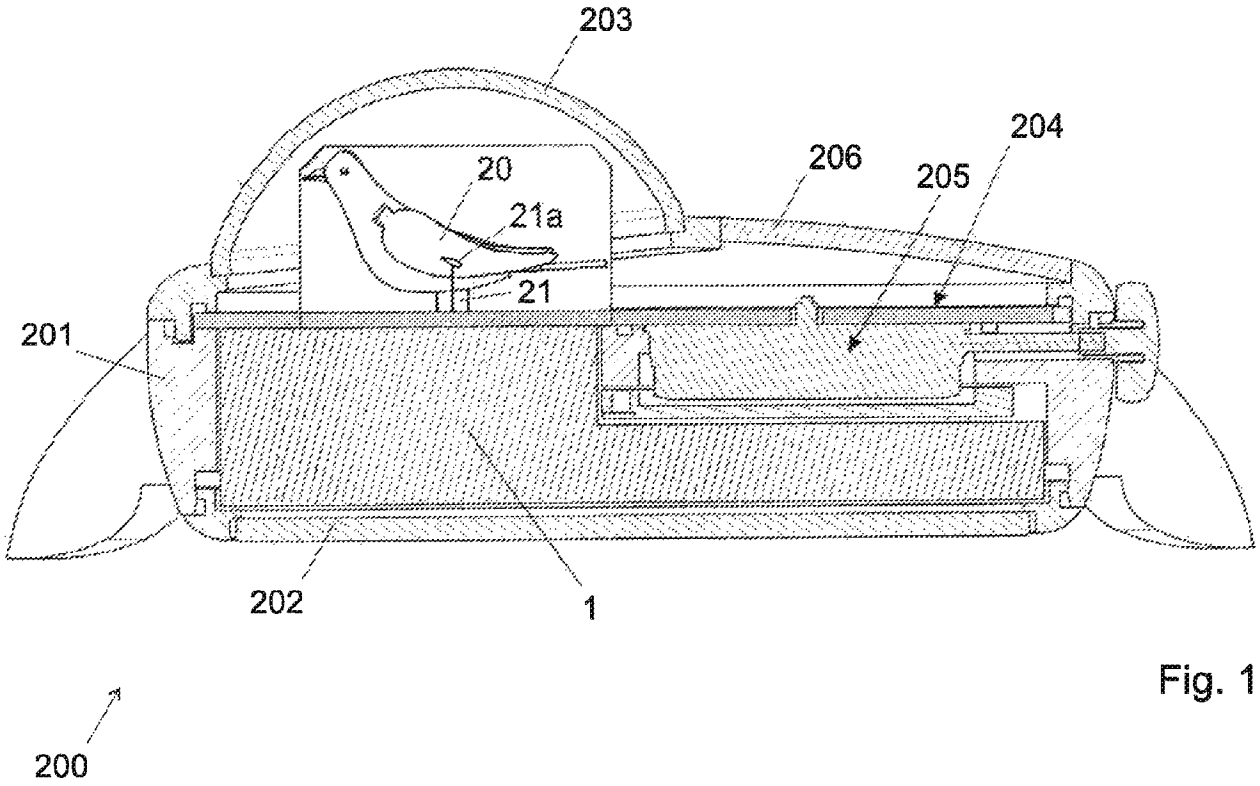
FIG. 1 is a cutaway view of a wristwatch according to the invention.

FIG. 1 shows a watch case 200 comprising the device 1 for driving the FIG. 20 according to an embodiment of the invention. The watch case comprises a middle 201, a back 202 and a glass 203-206 in two parts glued or joined together, wherein one of the parts 206 covers the dial 204 with the hour display, whereas the most curved part of the glass 203 protects the FIG. 20, which extends above this dial 204 perpendicularly to this dial and is driven to rotate by the lever or shaft 21.

The element 205 is the watch movement, which in this embodiment is independent and does not cooperate with device for driving the FIG. 1. The watch movement 205 can be mechanical. In this embodiment the device 1 for driving the FIG. 20 occupies a space in the watch case to the side and below the space occupied by the movement 205. The movement 205 is off-centre in relation to the case and the hands (not shown) of the movement move to the side of the FIG. 20, which thus does not cover these hands.

However, drive devices 1 of the FIG. 3 on the same plate as the watch movement or on an auxiliary module cooperating with this movement are also conceivable.

The term dial in this application must be interpreted in a broad sense: it can either be a separate part, e.g. an enamelled part, a mother-of-pearl part etc., or in the case of a skeleton watch, for example, can be the upper surface of the movement, above which the hands of the wristwatch move. In general, the dial can be defined as the background, in front of which the hands and/or the animated figure move. The plane of the dial is the plane of the upper surface of the dial; in the case of a non-plane surface the plane of the dial is a plane parallel to the movement plane of the hands.

The FIG. 20 in this embodiment is formed by a three-dimensional mechanical bird, which extends in a protruding manner above the dial 204. The FIG. 20 can be made of a metallic material, e.g. a precious metal, ceramic or any other appropriate material. It can be produced by moulding, machining or folding using sheets of material. It can be provided with feathers.

The device 1 for driving the FIG. 20 can comprise a shaft 21 that passes through the dial 204 perpendicularly to the dial 204 to drive the FIG. 20 and move it. Several shafts 21, 21*a* can be arranged concentrically to independently drive the body of the bird and one or more parts of this bird, e.g. the tail, beak and/or wings. These parts can also be actuated independently of one another by several independent shafts. In an embodiment a hollow outer shaft 21 can cause the whole bird to rotate around this shaft in a plane parallel to the dial, whereas a shaft 21*a* on the inside of this shaft can cause a part of this bird to move in relation to the body of the bird. The shaft or shafts 21, 21*a* can be driven to rotate by the device 1 and/or to perform a longitudinal translational movement. In an embodiment the outer shaft 21 performs rotation movements around its longitudinal axis, whereas the shaft 21*a* controlling the parts of the bird performs translational movements back and forth along the same longitudinal axis on the inside of the shaft 21. It is possible to use more than two concentric shafts. It is possible to control several parts of the bird independently by means of independent movements of a single shaft.

The FIG. 20 can be hollow. It can house a part of the mechanism for controlling the movement of the parts of the figure in dependence on the movements of the shaft 21, 21*a*. For example, it can house a mechanism for operating the head, the beak, the wings and/or the tail of the bird in dependence on the movements of the shaft 21*a*. The mechanism inside the FIG. 20 can comprise a cam and/or a part that tilts against the force of a spring under the pressure of the shaft 21*a* in order to simultaneously move the beak, the wings and the tail in relation to the body of the bird. Several parts can be provided inside the bird to move different parts of this figure independently of one another.

In another embodiment the head of a shaft 21*a* can be fitted with a cam to cause the spread of the wings or a movement of another part of the bird when this shaft 21*a* is rotated 90° or at another angle in relation to the body of the bird.

The movements of the FIG. 20 can involve, for example, a rotation of the whole figure around the shaft 21 in a plane parallel to the dial 204 and to the movement plane of the hands. The FIG. 20 can perform several rotations on itself, for example. The shaft 21 can also be controlled by means of a rack to perform reciprocating rotation movements and to reverse the direction of rotation of the bird.

It is also possible to move the whole figure in a plane or in a direction non-parallel to the dial 204, e.g. to cause it to come out of the dial, e.g. by pivoting around a horizontal axis and/or appearing through an opening shutter. Parts of the figure, e.g. the wings, beak, tail etc., can move in relation to the body of the figure, e.g. by performing a rotation in relation to the body of this figure around an axis non-perpendicular to the dial 204.

Figure 2:
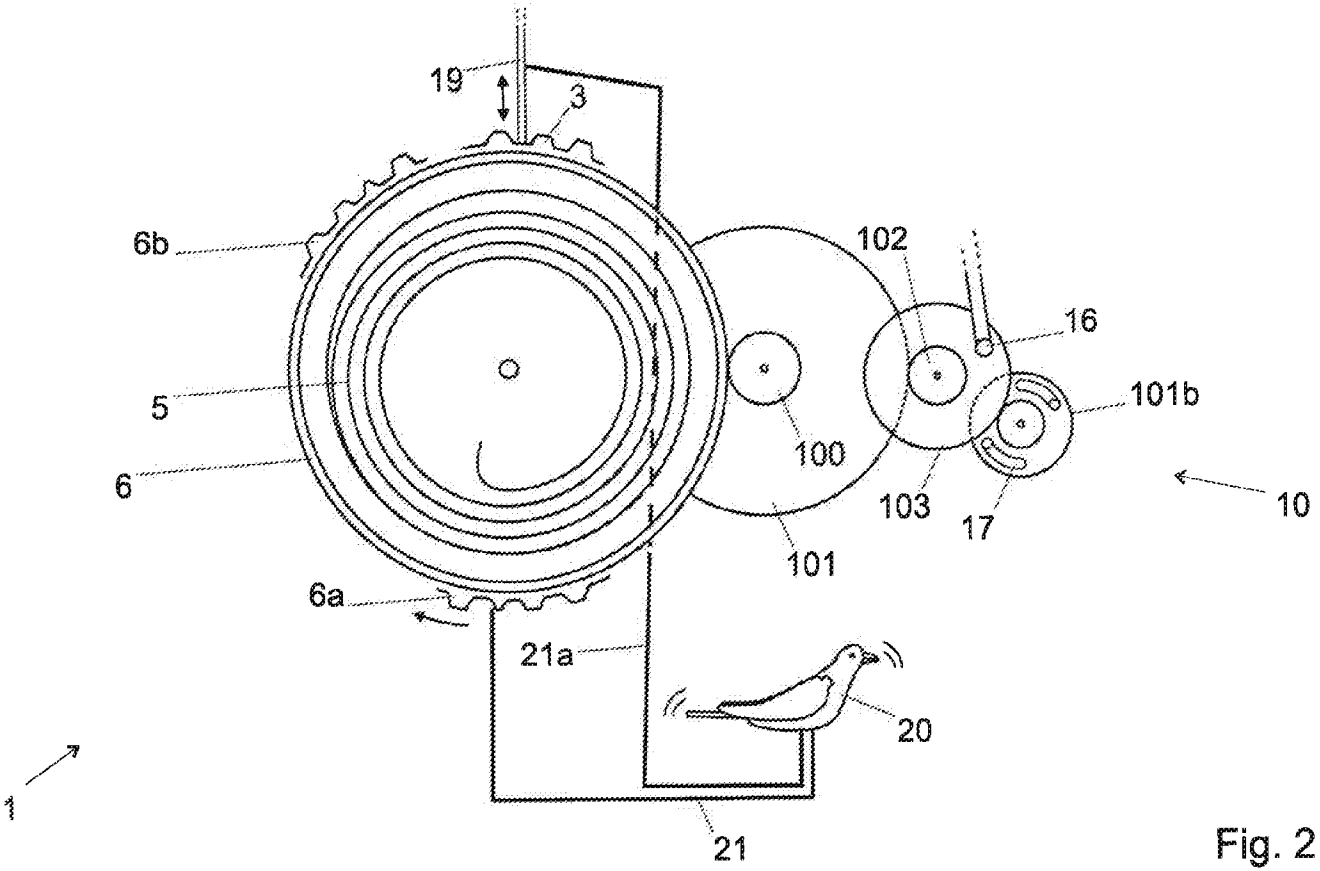
FIG. 2 schematically shows a portion of device for driving the figure according to the invention.

FIG. 2 shows an example of a portion of the device 1 for driving the FIG. 1 by means of the shaft 21 or shafts 21, 21*a*. The device comprises a barrel 5 fitted with an outer toothing 6 engaging with a pinion 100 of a kinematic chain 10. The pinion 100 is mounted on the axis of a wheel 101 driving a second pinion 102 on the axis of the wheel 103. The gear ratio between the barrel 5, which performs a rotation in two seconds, for example, and the wheel 103, which performs ten rotations per second, for example, is advantageously in the range of between 1/5 and 1/50, e.g. 1/20. This speed ratio can also be obtained with a different number of wheels and pinions (at the same time referred to as "wheels") in the kinematic chain 10.

The barrel 5 is also fitted with cams 3, 6*a*, 6*b*, e.g. cams mounted on its periphery, in order to animate a FIG. 20 and/or actuate various other mechanisms, e.g. elements of a whistle mechanism. The wheel 103 is fitted with an eccentric 16 or a cam that enables actuation of a rod (not shown) to move the piston of a pump that produces the air injected into the whistle.

The kinematic chain 10 additionally comprises a regulating member 17 formed here by inertia blocks on one of the wheels 101 b downstream of the wheel 103. The inertia blocks 17 move away from the centre of rotation of the wheel 101*b* when this starts to rotate, and this increases its moment of inertia and tends to slow down and control its speed and that of the whole of the kinematic chain. Other regulating mechanisms, including mechanisms based on a spring balance, brakes etc., can be used.

One or more of the wheels of the kinematic chain 10, e.g. the cams 3 and 6*a*, are connected to an articulated FIG. 20, e.g. a mechanical bird or another animated figure perpendicular to the dial, by means of connecting elements 21 and 21*a* in order to actuate this wheel when the kinematic chain rotates.

The cam 3 additionally enables a secondary mechanism to be actuated, e.g. a valve upstream of a whistle, to imitate the singing of the bird. The cam 6*b* enables a piston to be moved in the whistle to modulate the sound produced.

The cam 6*a* controls a lever (or shaft) 21 to control the rotation of the FIG. 20 on itself around an axis perpendicular to the dial 204 and passing through the FIG. 20. The rotation movement of this figure can be alternated causing successions of reciprocating movements and rotations in one direction then in another by means of a rack mechanism (not shown). The shaft 21 advantageously passes through the dial 204 perpendicularly to the dial.

The cam 3 additionally controls the lever (or shaft, arbor) 21*a*, which passes into a longitudinal opening through the shaft 21. Under the action of the cam 3 the lever 21 a advantageously moves in a translational movement along its longitudinal axis in order to control the movement of the beak, the wings and/or the tail of the bird 20 in relation to the body of the bird. The end of the lever 21*a* advantageously allows a lever to be pulled or pushed into the body of the bird against the force of a spring (not shown) in order to act simultaneously on the position of the beak, the wings and the tail, causing each of them to pivot around an axis non-perpendicular to the dial.

In a variant the shaft 21 a is a rotational shaft and acts through a cam or a rod on the movable parts of the FIG. 20.

Different shafts or levers can be provided to actuate various parts of the FIG. 20 independently, e.g. to move the wings independently of the tail or the beak. The different shafts or levers can be concentric.

The shaft or shafts 21, 21*a* enabling control of the FIG. 20 are thus actuated by one of the wheels of the kinematic chain. Different shafts 21, 21*a* can be driven at different speeds by different wheels. The rotational speed of the shafts can be irregular, e.g. under the effect of a cam, a Maltese Cross wheel etc. It is also possible to drive one or more shafts 21, 21*a* in translational motion.

An already mentioned whistle can be operated by a cam on the same kinematic chain 10 as the FIG. 20, e.g. by the same cam 3 as that which also acts on the shaft 21*a* to control the beak of the bird. Thus, the movements of opening the beak are perfectly synchronised with the sounds emitted by the whistle.

The whistle mechanism can comprise a piston to modulate the height of the note played. It can comprise a second piston operated by the kinematic chain 10 to pump the air into the whistle.

The device according to the invention can comprise an actuator, e.g. a pushbutton, a lever etc., that can be operated manually by the user to release the barrel 5 and to manually activate the movement of the FIG. 20. The operation of the actuator (not shown) allows the barrel to be released, in turn enabling animation of the figure. The same actuator, or a different actuator, can be used additionally to recharge the barrel 5.

In a variant the activation of the animation can also be effected automatically, e.g. on the passage of hours, half hours or even quarter hours. The animation can also be activated in a programmed manner, e.g. by means of a function of the watch, in particular an alarm, date function etc.

The present invention has been described with reference to a mechanical watch, but it could be applied to an electromechanical or electronic watch.

The invention has been described for a wristwatch, but it could be applied to other devices of small dimension having the above features taken in combination or independently of one another.

The invention claimed is:

1. A wristwatch comprising a watch case, a clock movement in said watch case and a dial, wherein said wristwatch further comprises:

a three-dimensional figure above said dial;

at least one shaft extending above said dial in a direction perpendicular to the dial and arranged in order to move at least a part of said three-dimensional figure in a plane non-parallel to the dial; and a device for driving the figure below said dial to control the movements of said shaft, wherein said figure is formed by a mechanical bird.

2. The wristwatch according to claim 1, wherein said three-dimensional figure comprises at least one movable part in relation to the rest of the figure;

wherein said shaft controls the movements of said movable part.

3. The wristwatch according to claim 1, further comprising at least one shaft extending above said dial in a direction perpendicular to the dial arranged in order to move said three-dimensional figure in a plane parallel to the dial.

4. The wristwatch according to claim 3, further comprising several coaxial shafts extending above said dial in a direction perpendicular to the dial arranged in order to move at least one part of the figure independently of other parts thereof.

5. The wristwatch according to claim 1, wherein at least one of the beak, wings and tail of said mechanical bird are movable in relation to the body of the bird.

6. The wristwatch according to claim 5, wherein the body of said mechanical bird is hollow and houses a mechanism for moving the at least one of the beak, wings and tail of said bird in dependence on the movements of said shaft or shafts.

7. The wristwatch according to claim 1, further comprising a first cam acting on a first lever perpendicular to the dial to cause said figure to rotate on itself in a plane parallel to the dial.

8. The wristwatch according to claim 7, further comprising a second cam acting on a second lever perpendicular to the dial to cause a part of the figure to move in a plane non-parallel to the dial.

9. The wristwatch according to claim 8, wherein the second lever is controlled to move by performing translational movements along its longitudinal axis.

10. The wristwatch according to claim 1, wherein said clock movement and said device for driving the figure are independent of one another.

11. The wristwatch according to claim 1, wherein said device for driving the figure comprises a first barrel and wherein said clock movement comprises a second barrel.

12. The wristwatch according to claim 11, wherein said device for driving the figure comprises a first regulating member and wherein said clock movement comprises a second regulating member.

13. The wristwatch according to claim 1, wherein said clock movement drives said device for driving the figure.

14. The wristwatch according to claim 1, wherein said device for driving the figure comprises a whistle arranged to imitate the singing of a bird.

15. The wristwatch according to claim 14, further comprising a second cam acting at the same time on the beak of a mechanical bird to cause the beak to open or close and on said whistle to cause a whistling sound synchronised with said movements of the beak.

16. The wristwatch according to claim 1, further comprising a glass above said dial and said figure, wherein a first part of said glass covers said dial, a second part of said glass covers said figure, the second is more curved than the first part, the two parts are welded or glued to one another.

17. A wristwatch comprising a watch case, a clock movement in said watch case and a dial, wherein said wristwatch further comprises:

a three-dimensional figure above said dial;

at least one shaft extending above said dial in a direction perpendicular to the dial and arranged in order to move at least a part of said three-dimensional figure in a plane non-parallel to the dial;

a device for driving the figure below said dial to control the movements of said shaft; and a first cam acting on a first lever perpendicular to the dial to cause said figure to rotate on itself in a plane parallel to the dial.

18. A wristwatch comprising a watch case, a clock movement in said watch case and a dial, wherein said wristwatch further comprises:

a three-dimensional figure above said dial;

at least one shaft extending above said dial in a direction perpendicular to the dial and arranged in order to move at least a part of said three-dimensional figure in a plane non-parallel to the dial; and a device for driving the figure below said dial to control the movements of said shaft, wherein said device for driving the figure comprises a whistle arranged to imitate the singing of a bird.

* * * * *